US007832389B2

(12) United States Patent
Christopher

(10) Patent No.: US 7,832,389 B2
(45) **Date of Patent: *Nov. 16, 2010**

(54) MAGNETIC DRIVE BYPASS SYSTEM FOR PAINTBALL LOADER

(75) Inventor: James T. Christopher, Sachse, TX (US)

(73) Assignee: Kee Action Sports I LLC, Sewell, NJ (US)

( * ) Notice: Subject to any disclaimer, the term of this patent is extended or adjusted under 35 U.S.C. 154(b) by 568 days.

This patent is subject to a terminal disclaimer.

(21) Appl. No.: 11/548,588

(22) Filed: Oct. 11, 2006

(65) Prior Publication Data

US 2007/0137631 A1 Jun. 21, 2007

Related U.S. Application Data

(60) Provisional application No. 60/725,395, filed on Oct. 11, 2005.

(51) Int. Cl.
*F41B 11/02* (2006.01)

(52) U.S. Cl. ..... 124/51.1

(58) Field of Classification Search ..... 124/51.1
See application file for complete search history.

(56) References Cited

U.S. PATENT DOCUMENTS

| | | | |
|---|---|---|---|
| 1,403,689 | A | 1/1922 | Hyndman |
| 1,403,719 | A | 1/1922 | Szepe |
| 1,404,689 | A | 1/1922 | Fairweather |
| 1,743,576 | A | 1/1930 | Bigham |
| 1,867,513 | A | 7/1932 | Johannes |
| 2,307,015 | A | 1/1943 | Boynton |
| 2,357,951 | A | 9/1944 | Hale |
| 2,398,263 | A | 4/1946 | Trimbach |
| 2,639,904 | A | 5/1953 | McMaster |
| 3,248,008 | A | 4/1966 | Meierjohan |
| 3,384,354 | A | 5/1968 | Albrecht et al. |
| 3,467,073 | A | 9/1969 | Rhodes |
| 3,610,223 | A | 10/1971 | Green |
| 3,695,246 | A | 10/1972 | Filippi et al. |
| 3,788,298 | A | 1/1974 | Hale |
| 3,789,891 | A | 2/1974 | Bosch |

(Continued)

FOREIGN PATENT DOCUMENTS

| | | |
|---|---|---|
| DE | 876370 | 5/1953 |

(Continued)

OTHER PUBLICATIONS

WARPIG—World and Regional Paintball Information Guide, http://www.warpig.com/paintball/technical/loaders/halo/index.shtml, WARPIG.COM, Odyssey Readies Halo for Production, by Bill Mills, Jun. 2001, pp. 1 to 5.

(Continued)

*Primary Examiner*—John Ricci
(74) *Attorney, Agent, or Firm*—Volpe and Koenig, P.C.

(57) ABSTRACT

A drive system for a regulating the rotation of a drive system or agitator in a paintball loader is disclosed. It is designed to regulate the rotation of a feeder, especially during a jam or when projectiles in a hopper become misaligned. This allows a user to quickly and effectively clear a jam and resume or continue rapid fire without damaging projectiles, the loader or the paintball marker.

21 Claims, 23 Drawing Sheets

U.S. PATENT DOCUMENTS

| | | | |
|---|---|---|---|
| 3,844,267 | A | 10/1974 | Mohr |
| 3,855,988 | A | 12/1974 | Sweeton |
| 3,867,921 | A | 2/1975 | Politzer |
| 4,027,646 | A | 6/1977 | Sweeton |
| 4,185,824 | A | 1/1980 | Natwick |
| 4,207,857 | A | 6/1980 | Balka, Jr. |
| 4,332,097 | A | 6/1982 | Yatlor, Jr. |
| 4,646,709 | A | 3/1987 | Kholin |
| 4,759,435 | A | 7/1988 | Cedrone |
| 4,819,609 | A | 4/1989 | Tippmann |
| 4,850,330 | A | 7/1989 | Nagayoshi |
| 4,896,646 | A | 1/1990 | Kahelin et al. |
| 4,926,742 | A | 5/1990 | Ma et al. |
| 4,930,400 | A | 6/1990 | Brandl et al. |
| 4,936,282 | A | 6/1990 | Dobbins et al. |
| 4,951,548 | A | 8/1990 | Wixon et al. |
| 4,951,644 | A | 8/1990 | Viviani |
| 4,965,951 | A | 10/1990 | Miller et al. |
| 4,986,251 | A | 1/1991 | Lilley |
| 4,993,400 | A | 2/1991 | Fitzwater |
| 5,063,905 | A | 11/1991 | Farrell |
| 5,097,816 | A | 3/1992 | Miller |
| 5,097,985 | A | 3/1992 | Jones |
| 5,166,457 | A | 11/1992 | Lorenzetti |
| 5,282,454 | A | 2/1994 | Bell et al. |
| 5,335,579 | A | 8/1994 | David |
| 5,353,712 | A | 10/1994 | Olson |
| 5,361,746 | A | 11/1994 | Szente |
| 5,383,442 | A | 1/1995 | Tippmann |
| 5,456,153 | A | 10/1995 | Bentley et al. |
| 5,490,493 | A | 2/1996 | Salansky |
| 5,497,758 | A | 3/1996 | Dobbins et al. |
| 5,505,188 | A | 4/1996 | Williams |
| 5,511,333 | A | 4/1996 | Farrell |
| 5,520,171 | A | 5/1996 | David |
| 5,542,570 | A | 8/1996 | Nottingham et al. |
| 5,561,258 | A | 10/1996 | Bentley et al. |
| 5,600,083 | A | 2/1997 | Bentley et al. |
| 5,722,383 | A | 3/1998 | Tippmann |
| 5,727,538 | A | 3/1998 | Ellis |
| 5,736,720 | A | 4/1998 | Bell et al. |
| 5,749,797 | A | 5/1998 | Sunseri et al. |
| 5,771,875 | A | 6/1998 | Sullivan |
| 5,784,985 | A | 7/1998 | Lodico et al. |
| 5,791,325 | A | 8/1998 | Anderson |
| 5,794,606 | A | 8/1998 | Deak |
| 5,809,983 | A | 9/1998 | Stoneking |
| 5,816,232 | A | 10/1998 | Bell |
| 5,839,422 | A | 11/1998 | Ferris |
| 5,881,962 | A | 3/1999 | Schmidt et al. |
| 5,887,578 | A | 3/1999 | Backeris et al. |
| 5,947,100 | A | 9/1999 | Anderson |
| 5,954,042 | A | 9/1999 | Harvey |
| 6,032,395 | A | 3/2000 | Bentley et al. |
| 6,055,975 | A | 5/2000 | Gallagher et al. |
| 6,109,252 | A | 8/2000 | Stevens |
| 6,206,562 | B1 | 3/2001 | Eyraud et al. |
| 6,213,110 | B1 | 4/2001 | Christopher et al. |
| 6,220,237 | B1 | 4/2001 | Johnson et al. |
| 6,305,367 | B1 | 10/2001 | Kotsiopoulos |
| 6,327,953 | B1 | 12/2001 | Andresen |
| 6,347,621 | B1 | 2/2002 | Guthrie |
| 6,374,819 | B1 | 4/2002 | Ming-Hsien |
| 6,408,836 | B1 | 6/2002 | Ming Hsien |
| 6,408,837 | B1 | 6/2002 | Johnson et al. |
| D459,767 | S | 7/2002 | Rushton |
| 6,415,781 | B1 | 7/2002 | Perrone |
| 6,418,919 | B1 | 7/2002 | Perrone |
| 6,425,781 | B1 | 7/2002 | Bernstein et al. |
| 6,460,530 | B1 | 10/2002 | Backeris et al. |
| 6,467,473 | B1 | 10/2002 | Kotsiopoulos |
| 6,468,879 | B1 | 10/2002 | Lamure et al. |
| 6,481,432 | B2 | 11/2002 | Rushton et al. |
| 6,488,019 | B2 | 12/2002 | Kotsiopoulos |
| 6,502,567 | B1 | 1/2003 | Christopher et al. |
| 6,526,955 | B1 | 3/2003 | Juan |
| 6,588,412 | B2 | 7/2003 | Ferrara et al. |
| 6,591,824 | B2 | 7/2003 | Hatcher |
| 6,609,511 | B2 | 8/2003 | Kotsiopoulos |
| 6,615,814 | B1 | 9/2003 | Rice et al. |
| 6,644,293 | B2 | 11/2003 | Jong |
| 6,684,873 | B1 | 2/2004 | Anderson |
| 6,701,907 | B2 | 3/2004 | Christopher et al. |
| 6,708,685 | B2 | 3/2004 | Masse |
| 6,725,852 | B1 | 4/2004 | Yokota |
| 6,729,321 | B2 | 5/2004 | Ho |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,742,512 | B1 | 6/2004 | Ho |
| 6,752,137 | B2 | 6/2004 | Brunette |
| 6,792,933 | B2 | 9/2004 | Christopher et al. |
| 6,802,306 | B1 | 10/2004 | Rice |
| 6,860,258 | B2 | 3/2005 | Farrell |
| 6,889,680 | B2 | 5/2005 | Christopher et al. |
| 6,915,792 | B1 | 7/2005 | Sheng |
| 6,978,776 | B2 | 12/2005 | Hamilton |
| 6,981,493 | B1 | 1/2006 | Poteracku |
| 7,017,569 | B2 | 3/2006 | Jong |
| 7,021,302 | B2 | 4/2006 | Neumaster |
| 7,040,505 | B2 | 5/2006 | Hashimoto et al. |
| 7,077,118 | B2 | 7/2006 | Lewis |
| D535,339 | S | 1/2007 | Broersma |
| 7,159,585 | B2 | 1/2007 | Quinn et al. |
| 7,222,617 | B2 | 5/2007 | Andresen |
| D544,047 | S | 6/2007 | Bell et al. |
| 7,234,456 | B2 | 6/2007 | Andresen |
| 7,270,121 | B2 | 9/2007 | Lubben |
| 7,343,909 | B2 | 3/2008 | Christopher |
| D567,302 | S | 4/2008 | Choi |
| D567,303 | S | 4/2008 | Neumaster |
| 7,357,129 | B2 | 4/2008 | Neumaster et al. |
| 7,357,130 | B2 | 4/2008 | Broersma |
| 7,428,899 | B2 | 9/2008 | Andresen |
| 7,445,002 | B2 | 11/2008 | Christopher et al. |
| 2002/0059927 | A1 | 5/2002 | Woods |
| 2003/0079731 | A1 | 5/2003 | Dobbins |
| 2004/0074487 | A1 | 4/2004 | Christopher et al. |
| 2004/0074489 | A1* | 4/2004 | Neumaster et al. ..... 124/79 |
| 2004/0112356 | A1 | 6/2004 | Hatcher |
| 2004/0211402 | A1 | 10/2004 | Christopher et al. |
| 2005/0121015 | A1 | 6/2005 | Postorivo, Jr. |
| 2005/0241628 | A1 | 11/2005 | Hatcher |
| 2005/0274370 | A1 | 12/2005 | Lubben |
| 2005/0284456 | A1 | 12/2005 | Chipley |
| 2005/0284457 | A1 | 12/2005 | Hatcher |
| 2006/0005823 | A1 | 1/2006 | Quinn |
| 2006/0032488 | A1 | 2/2006 | Telford |
| 2006/0037597 | A1 | 2/2006 | Wood |
| 2006/0086347 | A1 | 4/2006 | Hedberg |
| 2006/0124118 | A1 | 6/2006 | Dobbins |
| 2006/0196489 | A1 | 9/2006 | Campo |
| 2006/0249131 | A1 | 11/2006 | Broersma |
| 2006/0254572 | A1 | 11/2006 | Hall |
| 2007/0017494 | A1 | 1/2007 | Andresen |
| 2007/0017495 | A1 | 1/2007 | Andresen |
| 2007/0056573 | A1 | 3/2007 | Campo |
| 2007/0062506 | A1 | 3/2007 | Bell |
| 2007/0101981 | A1 | 5/2007 | Chen |
| 2007/0113834 | A1 | 5/2007 | Spicer |
| 2007/0137631 | A1 | 6/2007 | Christopher |
| 2008/0047537 | A1 | 2/2008 | Kulp et al. |

2009/0133680 A1 5/2009 Christopher et al.

FOREIGN PATENT DOCUMENTS

| | | |
|---|---|---|
| DE | 2035097 | 8/1982 |
| DE | 3721527 | 1/1989 |
| DE | 4343870 | 6/1994 |
| DE | 4343871 | 6/1995 |
| DE | 19922589 | 12/2000 |
| EP | 0075970 | 4/1983 |
| EP | 01054228 | 11/2000 |
| EP | 01653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6325233 | 11/1994 |
| WO | 98/13660 | 4/1998 |
| WO | 01/44745 | 6/2001 |
| WO | 02/42708 | 5/2002 |
| WO | 03087698 | 10/2003 |
| WO | 2007/035601 | 3/2007 |
| WO | 2007033309 | 3/2007 |
| WO | 2007044546 | 4/2007 |
| WO | 2007044822 | 4/2007 |
| WO | 2008104061 | 4/2008 |

OTHER PUBLICATIONS

WARPIG—World and Regional Paintball Information Guide, http://www.warpig.com/paintball/technical/loaders/halo/review.shtml, WARPIG.COM, Odyssey Halo by Bill Mills, Dec. 2001, pp. 1 to 7.

Odyssey Halo B Paintball Hopper Review, http://www.paintball-gun-review.com/hopper-reviews/odyssey-halo-b..., Paintball Gun Review, Odyssey Halo B Paintball Hopper Review, 2004 Paintball-Gun-Review.com, pp. 1 to 4.

www.ODYSSEYPAINTBALL.com, http://web.archive.org/web/20030205112543/http://www.ODYSSEYPAIN..., Odyssey Paintball Products, Understanding Halo B, pp. 1 to 3.

* cited by examiner

MAGNETIC DRIVE BYPASS SYSTEM FOR PAINTBALL LOADER

CLAIM OF PRIORITY

This application claims benefit of U.S. Provisional Patent Application No. 60/725,395, filed Oct. 11, 2005, the entire contents of which is incorporated by reference herein.

FIELD OF INVENTION

This invention relates to the field of projectile loaders for feeding projectiles to, for example, compressed gas guns.

BACKGROUND

Paintball, a popular sport has developed over the years, which uses paintball markers (guns), which are guns utilizing compressed gas to fire projectiles. Some examples of paintball guns are those offered under the brand names 32 DEGREES™, EMPIRE™, DIABLO™, and INDIAN CREEK DESIGNS™, and others shown and described in U.S. Pat. Nos. 6,708,685; 4,936,282; 5,497,758; and U.S. application Ser. Nos. 11/183,548; 11/180,506; 11/150,002; 11/064,693; 10/313,465; 10/090,810, the entire contents of which are all incorporated fully herein by reference. Players use the paintball guns to shoot projectiles known as paintballs (projectiles and paintballs are used interchangeably herein). These paintballs are spherical, frangible projectiles normally having gelatin or starch-based shells filled with paint (coloring or dye). The shells break when impacting a target, allowing the paint within to splatter on the target. The sport of paintball is often played like capture the flag. A player is eliminated from the game when the player is hit by a paintball fired from an opposing player's marker. When the paintball hits a target such as a player, a mark or "splat" of paint is left on the player.

Paintball loaders (otherwise known as hoppers or magazines, and also referred to herein as "projectile loaders") sit atop the markers and feed projectiles into the marker. These projectile loaders (the terms "hopper," "magazine," and "loader" are used interchangeably herein) store projectiles, and have an outlet or exit tube (out feed tube or neck). The outlet tube is connected to an inlet tube (or feed neck) of a paintball marker, which is in communication with the breech of the paintball marker. Thus, the loaders act to hold and feed paintball projectiles into the breech of a paintball marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other mechanism, such as those shown and described in U.S. Pat. Nos. 6,213,110; 6,502,567; 5,947,100; 5,791,325; 5,954,042; 6,109,252; 6,889,680; and 6,792,933, the entire contents of which are incorporated by reference herein. In a "gravity feed" or "agitating" loader, an agitator mixes projectiles so that no jams occur at the exit opening of the outlet tube. In a "force feed" or "active feed" paintball loader, the agitator (drive cone, carrier, paddle or any other force feed drive system) forces projectiles through the exit tube. Because it is desirable to eliminate as many opposing players as possible, paintball markers are capable of semi-automatic rapid fire. The paintball loaders act to hold a quantity of projectiles, and ensure proper feeding of the projectiles to the marker for firing.

Modern paintball loaders utilize projections, paddles, arms, carriers, drive cones, or other agitators to mix or advance paintballs. These agitators are operated by motors, which are usually electrical, and powered by a power source such as a battery.

One critical problem with current paintball loaders is when such loaders and the agitators in such loaders encounter a jammed paintball (such as when a paintball is jammed such as at an exit opening or cannot otherwise move), paintball breakage can occur. In addition, the motors may be damages if they cannot operate or become jammed.

Thus, there is the need for a paintball loader that can continue to operate, even when a paintball jam occurs, and that will not break paint or damage the motor of a paintball agitator when encountering a jam or other disruption in operation.

SUMMARY

The present invention is a drive system for a paintball loader comprising a drive shaft rotatable about a central axis, a drive mechanism rotatable about a drive shaft, the drive mechanism including a first magnetic surface, a feed mechanism carrier adjacent the drive mechanisms including at least one magnetically attractable portion that is attractable to the magnet of the drive mechanism.

In another embodiment, the present invention is a drive system for a paintball loader comprising a drive shaft rotatable about a central axis, a drive mechanism attached to the drive shaft, the drive mechanism having a magnetically attractable portion, a feed mechanism carrier attachable to a feeder adjacent the drive mechanism and rotatable about the drive shaft, the feed mechanism carrier having at least one magnet that is attractable to the magnetically attractable portion of the drive mechanism.

In another embodiment, the present invention is a drive system for a paintball loader comprising a drive shaft rotatable about a central axis, having a magnet attached thereto, the drive shaft extending vertically through a hole in a feed mechanism carrier that is rotatable about the drive shaft, wherein the feed mechanism carrier has at least one magnetically attractable portion that is attractable to the magnet of the drive shaft.

In another embodiment, the present invention is a drive system for a paintball loader comprising a drive shaft rotatable about a central axis, having a magnetically attractable portion attached thereto, the drive shaft extending vertically through a hole in a feed mechanism carrier attachable to a feeder, the feed mechanism carrier rotatable about the drive shaft and having at least one magnet that is attractable to the magnetically attractable portion of the drive shaft.

In another embodiment, the present invention is a drive system for a paintball loader comprising a drive shaft rotatable about a central axis, a feed mechanism carrier connected to the drive shaft, the feed mechanism carrier having at least one sloped upper portion and a spring attached thereto, the feed mechanism carrier in contact with a feeder, a spring attached to the feeder, the spring contained and moveable within a spring guide.

In one embodiment, the present invention controls the rotation of a paintball feeder so that it will cease rotation and thereby not impart force on projectiles when they jam. It also resumes operation immediately upon clearing the jam. In another embodiment, the present invention allows the paintball feeder to rotate above jammed projectiles. In every embodiment disclosed below, the present invention is easily "retrofitted" so that it can be used with all existing styles of paintball loaders, including, but not limited to "force feed", "active feed", and "agitating" loaders.

DETAILED DESCRIPTION OF THE PREFERRED EMBODIMENTS

As used herein, the term "binding element" refers to either a magnet or a magnetically attractable element. As used herein, a "magnetically attractable element" can be any element that is attracted to a magnet including, but not limited to, ferromagnetic materials such as iron, nickel, cobalt, neodymium, etc. As used herein, the terms "feeder", "feed mechanism", or "impeller" refer to any apparatus that impels, moves, pushes, agitates, or otherwise mixes projectiles within a loader or hopper, such as an agitator, arms, fins, paddles, paddle arms, spokes, drive cones, carriers, including, but not limited to, those shown and described in U.S. Pat. Nos. 6,213,110; 6,502,567; 5,947,100; 5,791,325; 5,954,042; 6,109,252; 6,889,680; and 6,792,933, the entire contents of which are incorporated by reference herein, and those used in commercially available paintball loaders such as the various HALO® brand paintball loaders, the EMPIRE RELOADER™ paintball loaders, and substitutes or equivalents thereof.

Figure 1:
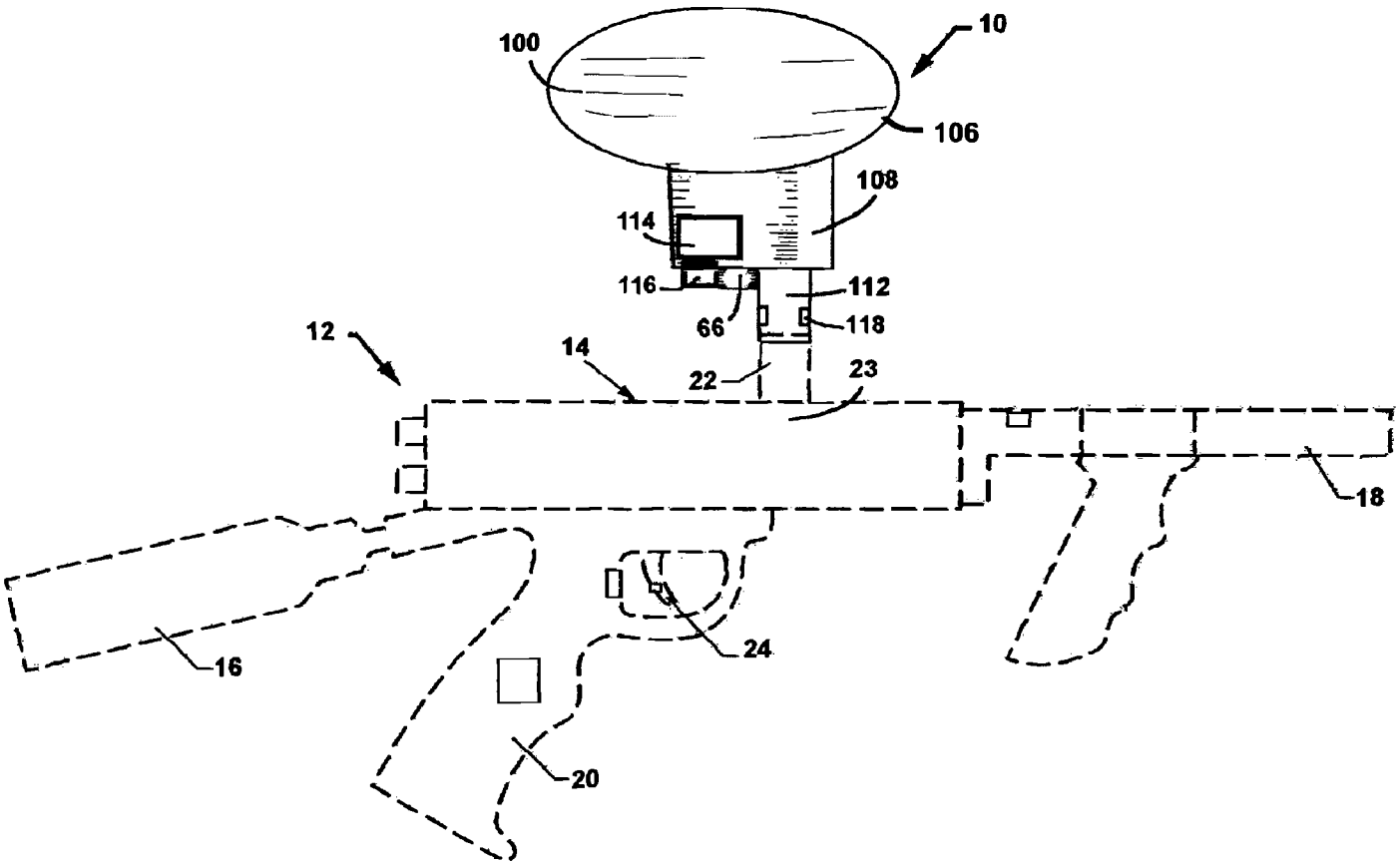
FIG. 1 is a side elevational view of an illustrative paintball loader operatively attached to a paintball marker illustrated in phantom.

FIG. 1 is a side elevational view of an illustrative paintball loader 10 attached to a representative paintball gun 12 illustrated in phantom. The paintball gun 12 includes a main body 14, a compressed gas cylinder (gas tank) 16, a barrel 18, and a grip portion 20. The paintball gun also includes an inlet tube 22 (also called a feed neck) leading to a firing chamber (or breech) in the interior of the main body 14, and a trigger 24. The compressed gas cylinder 16 is typically secured to a rear portion of the paintball gun 12. The compressed gas cylinder normally contains $CO_2$ or $NO_2$, although any compressible gas may be used.

Figure 2:
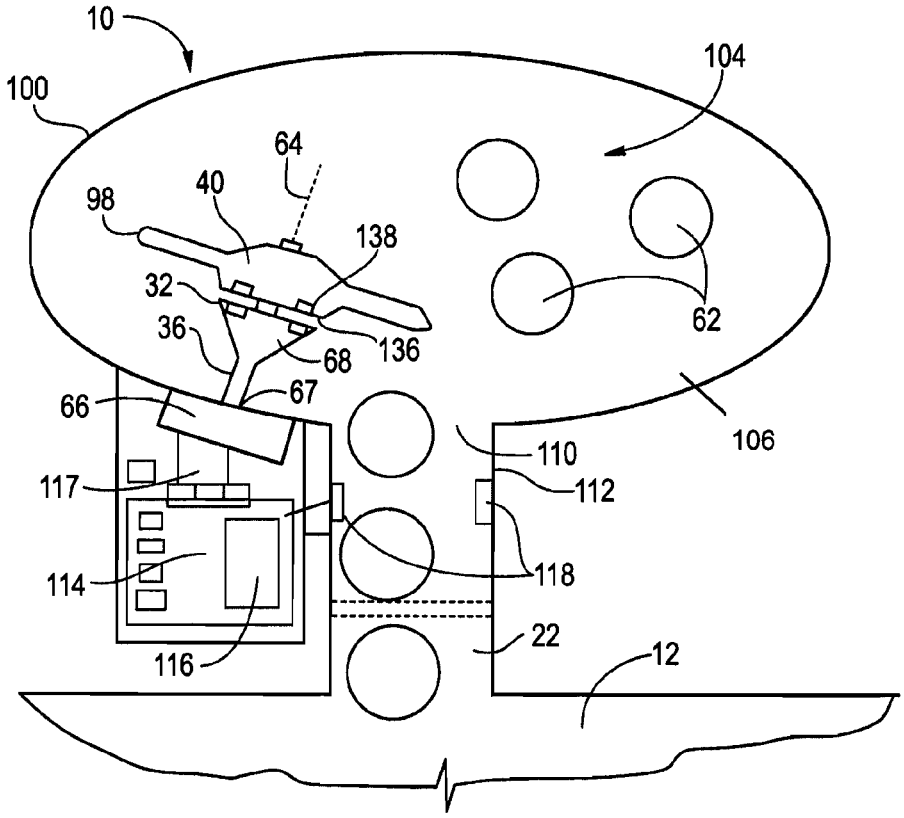
FIG. 2 is a side cross sectional view of an embodiment of an illustrative paintball loader according to the present invention.

An exemplary paintball loader 10 is shown in more detail in FIGS. 1-2. The paintball loader 10 includes a loader body 100 forming an interior area 104. The loader body 100 may be divided into an upper portion 106 and a lower portion 108. Generally, an exit portion 110, such as an opening, leads from the lower portion 108 of the loader body 100 to an outfeed tube 112, although the exit portion 110 may be positioned at another location in the loader body 100. The exit portion 110 is positioned adjacent the inlet tube 22 of the compressed gas gun 12. The paintball loader 10 includes a motor 66. The motor 66 may be in communication with a controller 114 and/or microprocessor 116 for controlling at least one operation of the loader 10. In addition, at least one sensor 118 may be provided in communication with the motor 66, controller 114 and/or microprocessor 116, or any combination of those, for detecting the presence or absence of projectiles 62 in the exit portion 110 or outfeed tube 112 of the loader 10, or positioned at other locations within or about the loader body 100. A power source such as a battery 117 may be provided for powering the motor 66, controller 114, microprocessor 116, or any combination thereof.

Figure 3:
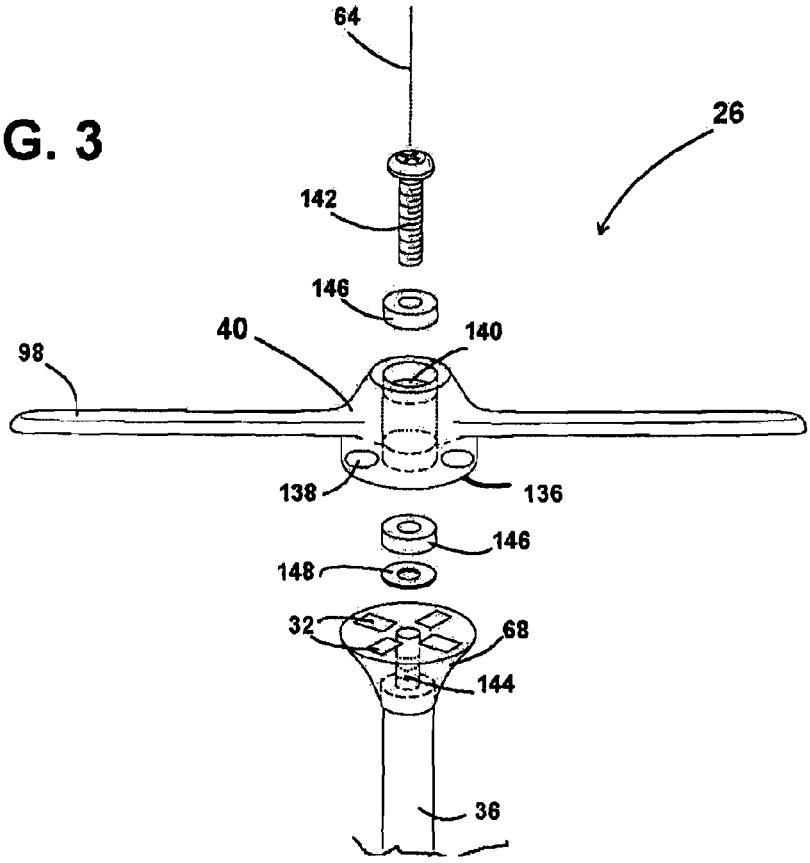
FIG. 3 is an exploded isometric view of a first embodiment of a drive mechanism for a paintball loader according to the present invention.

A first embodiment of a drive mechanism for a paintball loader according to the present invention is shown in FIGS. 2-3. A drive mechanism 26 according to an embodiment of the present invention includes a drive shaft 36 that rotates about a central axis 64. The drive shaft 36 is coupled at its first end 67 to a motor 66 for rotating the drive shaft 36, which may be an electrical motor, a stepper motor, a wind up or spring operated motor, or any other means for rotating or otherwise operating the drive mechanism 26. The second end or upper portion 68 of the drive shaft 36 includes at least one binding element 32. In the preferred embodiment, the binding element 32 is a magnet or a magnetically attractable insert, such as a ferrous metal, or other metal attracted to a magnet.

As shown in greater detail in FIG. 3, the feed mechanism 40 is positioned adjacent the second end or upper portion 68 of the drive shaft 36. The feed mechanism 40 may include arms 98 (fins, paddles, or other extensions) such as shown in FIGS. 2-3, adapted for mixing or moving paintballs contained with a paintball loader 10. The feed mechanism 40 includes a lower portion 136 including at least one second binding element 138. The second binding element 138 may be a magnet of different polarity as the binding element 32 (if the binding element 32 is a magnet), or may be a magnetically attractable insert (if the binding element 32 is a magnet), or may be a magnet of any polarity (if the binding element 32 is a magnetically attractable insert).

The feed mechanism 40 includes an opening 140 for receiving a screw 142. The screw 142 is preferably sized smaller than the opening 140, and is received in a threaded opening 144 in the upper portion 68 of the drive shaft 36. In this arrangement, the feed mechanism 40 is free to rotate about the screw 142. A bushing (or bearing) 146 and/or washer 148 may be provided for assisting free rotation of the feed mechanism 40. It is appreciated that a thinner diameter portion extension of the drive shaft 36 may extend though the opening 140, and may be affixed in place with a screw or other connection means.

When the motor 66 operates the drive shaft 36, the drive shaft 36 will rotate in either a clockwise or counterclockwise direction about the central axis 64. The binding element 32 and second binding element 138 will have a magnetic attraction to each other. Thus, when the drive shaft 36 rotates, the binding element 32 will impart (or have imparted upon it) a magnetic force (adhesion force) on the second binding element 138, that will rotate in tandem the feed mechanism 40 when there are no jammed paintballs in the paintball loader 10.

If a paintball jam is encountered, or if the paintballs cannot be agitated or otherwise moved for some reason, the drive shaft 36 will continue to rotate. With the feed mechanism 40 unable to continue rotation, the binding element 32 will rotate past the second binding element 138 of the feed mechanism 40 when the force of the motor 66 on the drive shaft 36 cannot overcome the force holding the feed mechanism 40 in place. In this manner, the motor 66 will not be damaged, and the feed mechanism 40 will not be forced to break or otherwise rupture paintballs that cannot be agitated.

Figure 4:
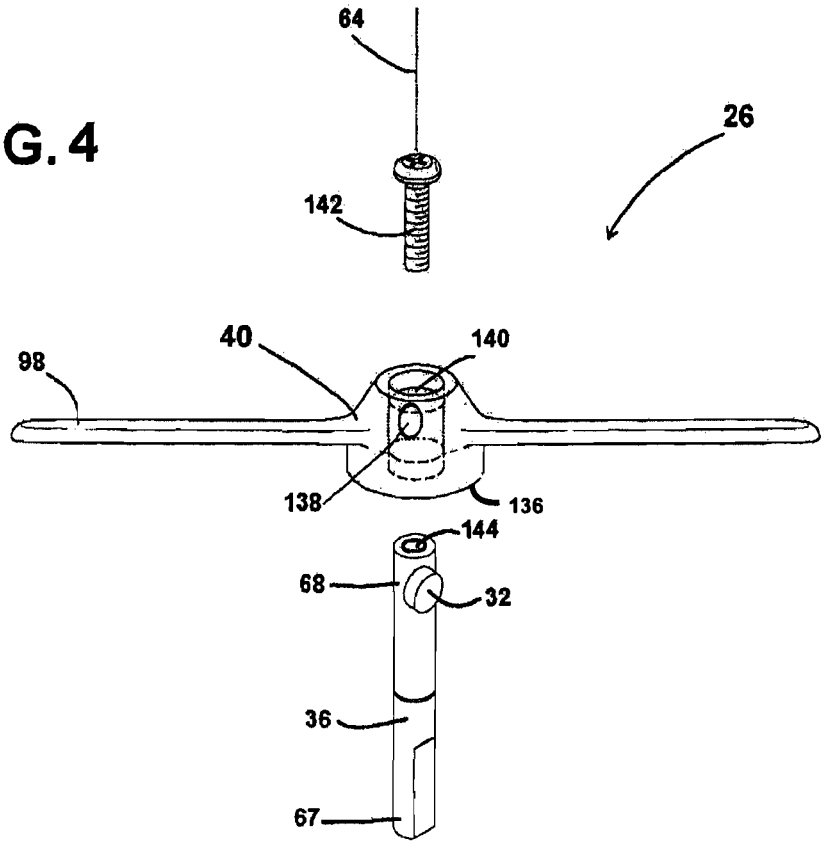
FIG. 4 is an exploded isometric view of a second embodiment of a drive mechanism for a paintball loader according to the present invention.

Accordingly, the present invention provides for a magnetic clutch system. When the drive shaft 36 continues to rotate, the binding element 32 will again come into proximity to the second binding element 138. The binding element 32 and second binding element 138 can be positioned at any location on or about the drive shaft 36 or the feed mechanism 40 to permit the binding element 32 and second binding element 138 to come into proximity and be in position so that a magnetic attraction occurs between the binding element 32 and second binding element 138. As shown in FIG. 4, a binding element 32 may be positioned or otherwise formed in a side wall 150 of the drive shaft 36, facing outwardly from the central axis 64. The feed mechanism 40 may have the second binding element 138 positioned facing toward the opening 140. The drive mechanism 26 will operate as previously with the magnetic clutch action described. Alternately, a portion of the drive shaft 26 can be formed from a magnet or magnetically attractable insert.

Figures 6A, 6B:
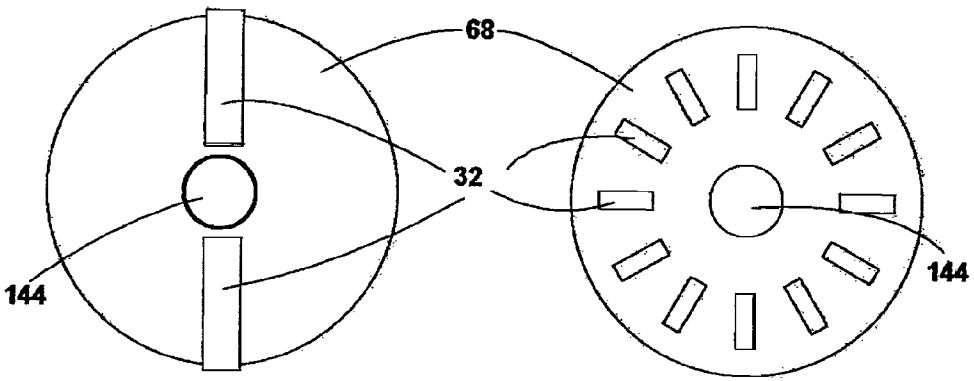
FIGS. 6A and 6B are top plan views of drive shafts of the present invention.
Figure 7:
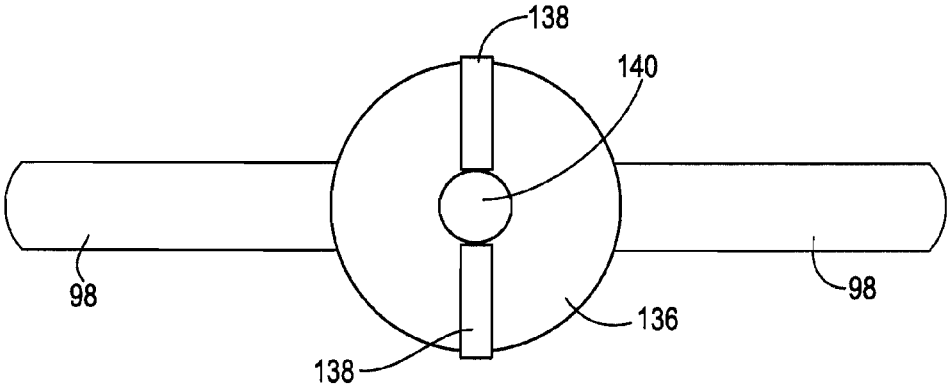
FIGS. 7 and 8 are bottom plan views of feed mechanisms of the present invention.
Figure 8:
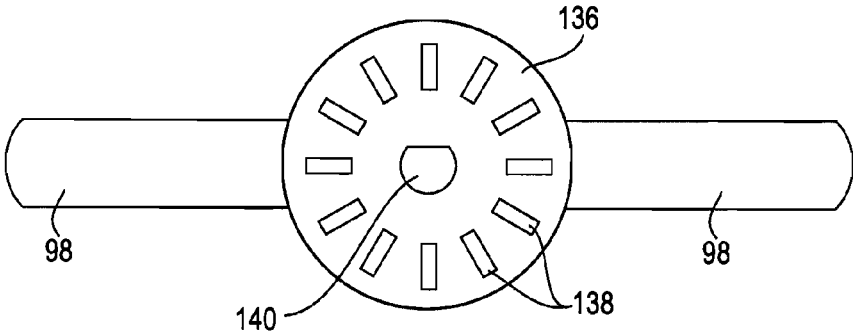

The second end 68 of the drive shaft 36 may include at last one or a plurality of binding elements 32, as shown in FIGS. 6A and 6B, top plan views of different embodiments of the drive shaft 26. Similarly, the feed mechanism 40 may include at last one or a plurality of binding elements 138, as shown in FIGS. 7-8. The operation of the drive mechanism 26 can be controlled by varying the number of binding elements, the strength of any magnets, and the distance between the binding element 32 and the second binding element 138, for example. The motor 66 may be controlled by the controller 114 such as an electronic control circuit that may include a microprocessor 116. The paintball loader 10 may include at least one sensor 118 in communication with the motor 66 and/or controller 114 for detecting paintballs, such as an electro-mechanical sensor or switch, an optical sensor, and infrared (IR) sensor, a sound or shockwave sensor, or any other sensor as are known in the art. The controller 114 can control rotation of the motor 66 in either direction, providing for a reversible feed mechanism 40 operation.

Figure 9:
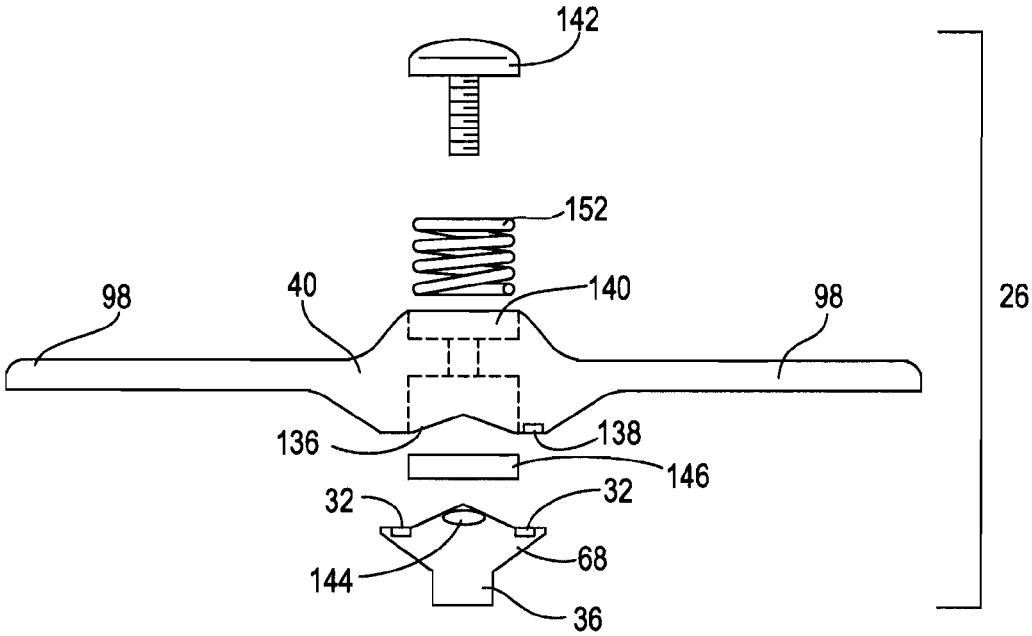
FIG. 9 is an exploded side elevational view of a fourth embodiment of a drive mechanism for a paintball loader according to the present invention.
Figure 10:
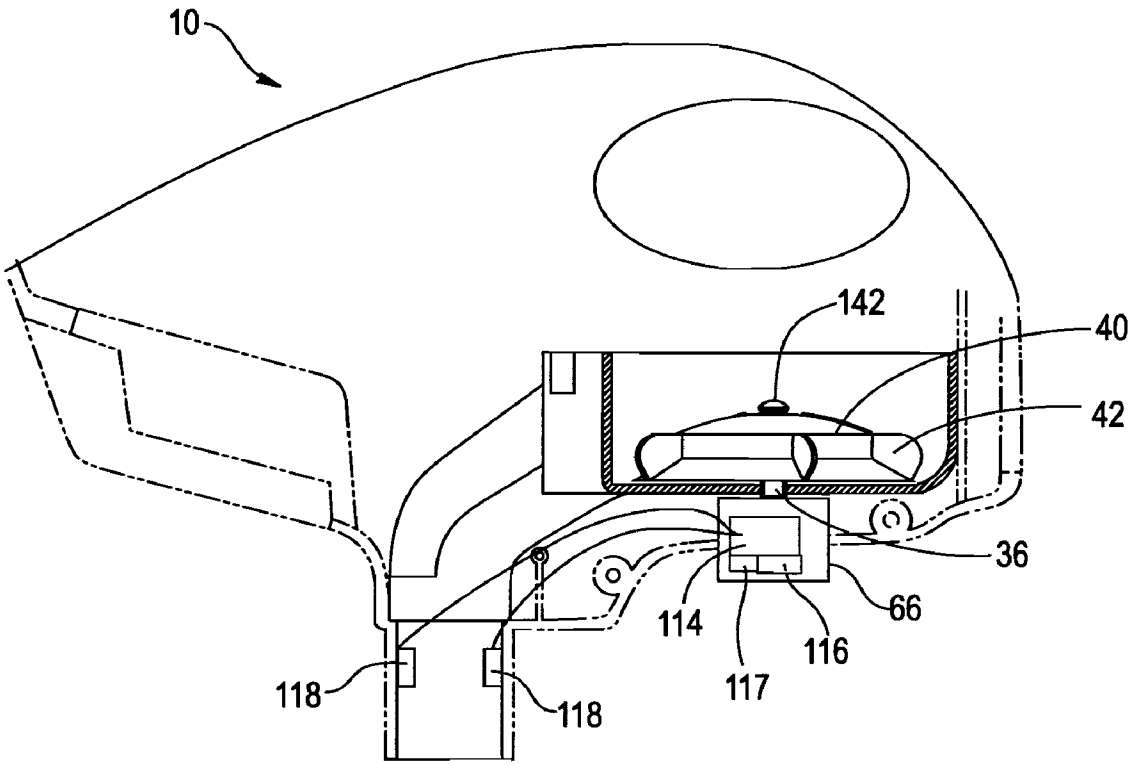
FIG. 10 is a side cross sectional view of a further embodiment of an illustrative paintball loader according to the present invention.
Figure 11:
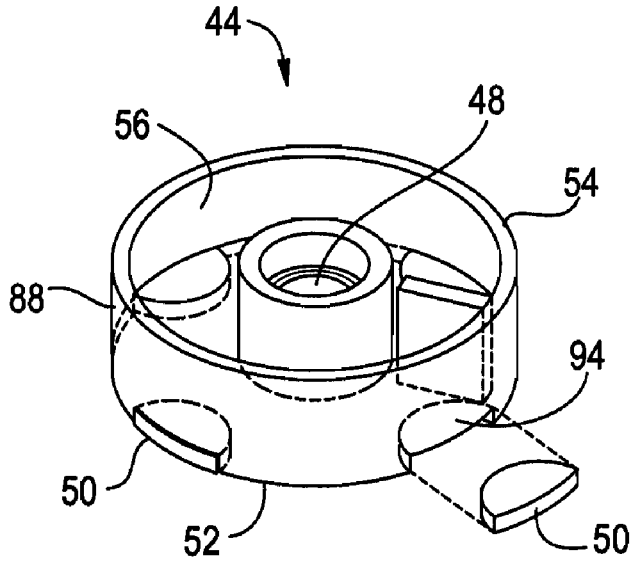
FIGS. 11-13, taken together, are an exploded isometric view of a still further embodiment of a drive mechanism for a paintball loader according to the present invention.

In an alternate embodiment, as shown in FIG. 9, the drive mechanism 26 includes a drive shaft 36 having an upper portion 68 that is contoured or angled. The lower portion 136 of the feed mechanism 40 is contoured complementary to the contour of the upper portion 68 of the drive shaft 36. A spring 152 is provided between the attachment screw 142 and the feed mechanism 40. At least one binding element 32 is positioned proximate the upper portion 68 of the drive shaft 36, and at least one second binding element 138 is positioned proximate the lower portion 136 of the feed mechanism 138, as previously described. In this arrangement, due to the complimentary contoured surfaces, the feed mechanism 40 is adapted for movement above and below its originally plane of movement if a projectile jam is encountered, in addition to the rotational movement of the feed mechanism 40 being driven by the drive shaft 36. The spring 152 biases the feed mechanism 40 back to its original position. An additional or alternate spring can be provided between the upper portion 68 of the drive shaft 36 and the lower portion 136 of the feed mechanism 40.

Figure 13:
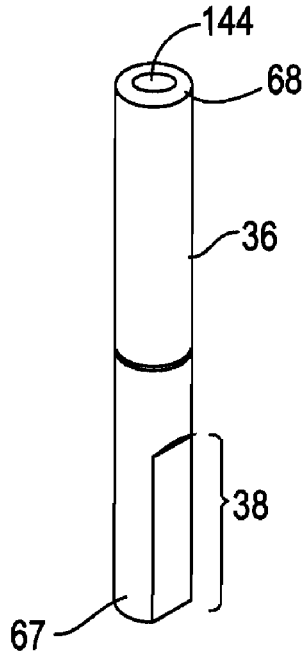
Figure 12:
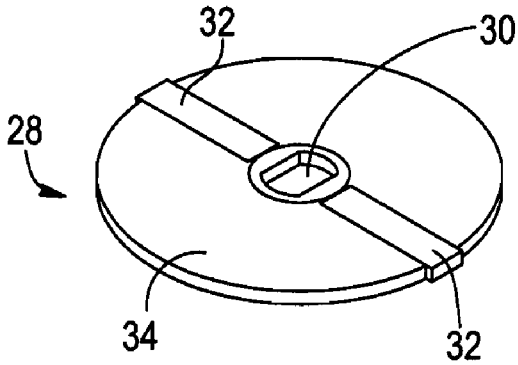
Figure 15:
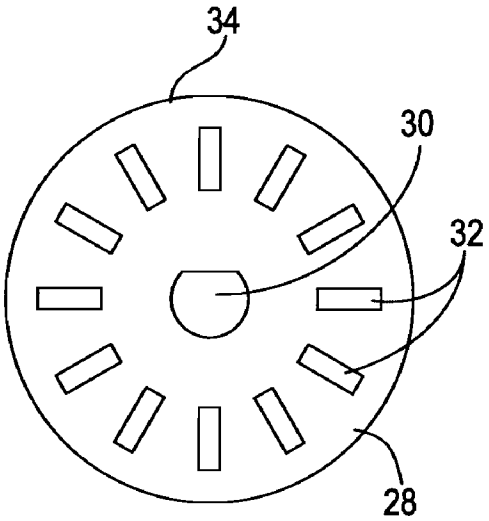
FIG. 15 is a top plan view of an alternate clutch plate of a drive mechanism according to the present invention.
Figure 14:
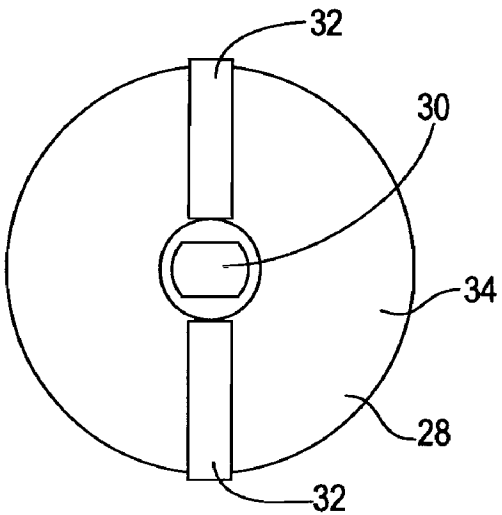
FIG. 14 is a top plan view of a clutch plate of a drive mechanism according to the present invention.
Figure 16:
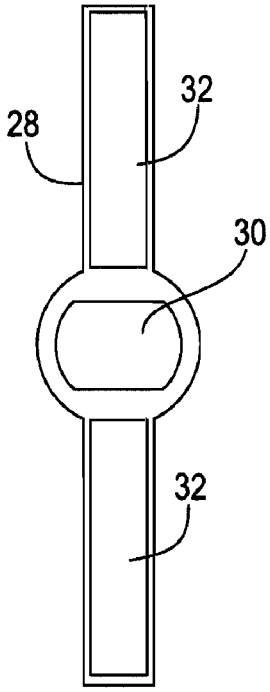
FIG. 16 is a top plan view of a further alternate clutch plate of a drive mechanism according to the present invention.

FIGS. 10-20 show an alternate embodiment of a drive mechanism 26 according to the present invention for use in a paintball loader 10. According to this embodiment, drive mechanism 26 includes a clutch plate 28, shown in detail in FIGS. 12, 14-16, having a keyed opening 30 therethrough, and including at least one binding element 32. In the preferred embodiment, the binding element 32 is a magnet, but may also be a magnetically attractable insert. The clutch plate 28 may include one or a plurality of binding elements 32, as shown in FIGS. 14 and 15. The clutch plate 28 is preferably formed as a disc 34 with the keyed opening 30 shaped to accept a keyed portion 38 of a drive shaft 36, as shown in FIG. 13. The opening 30 may be any shape for accepting the drive shaft 36, as shown in FIGS. 14 and 15, so long as the keyed portion 38 of the drive shaft 36 can rotate the plate 28. The clutch plate 28 can be any size and/or shape suitable for its purposes as disclosed below, such as the alternate embodiment shown in FIG. 16, and may be comprised of any metal, plastic, or other suitable materials. Preferably, the clutch plate 28 is formed from a plastic, or other non-metallic, non-magnetic material. It should be understood that the clutch plate 28 can also be permanently affixed and part of the drive shaft 36.

Alternatively, the plate 28 may be formed entirely from the material comprising the binding element 32, wherein the plate 28 may be entirely formed from a magnetic material, or entirely formed from a magnetically attractable material. The plate 28 may also be formed with the binding elements 32 fashioned as rectangular inserts, as shown in FIGS. 12, 14-16. The binding elements may be removable, or permanently affixed to the plate 28. Through the variation of the binding elements, one is able to adjust the attractive forces to correspond with the specific properties of the projectile.

FIGS. 13-17, 18 show a drive shaft 36 for providing movement to agitate, mix or move the projectiles 62 in the loader 10. The drive shaft 36 is adapted to rotate about its central axis under the force of a motor 66 to which it is coupled at its first end 67, preferably an electric, battery operated motor, although any motor is acceptable. The drive shaft 36 has an upper portion 68, which is preferably substantially circular and includes a threaded opening 144 for accepting a screw 142, and a lower keyed portion 38 shaped to engage the opening 30 of the clutch plate 28. Rotation of the drive shaft 36 by the motor 66 will in turn rotate the clutch plate 28, due to the engaging fit between the keyed portion 33 of the drive shaft 36 and the keyed opening 30 shown in FIGS. 14-16. The drive shaft 36 may be constructed of various materials, such as molded plastic or metal, and is sized and shaped so that it is capable of passing through the opening 16 of the clutch plate 28 and the openings 22 of the paintball feed mechanism 40.

Figure 17:
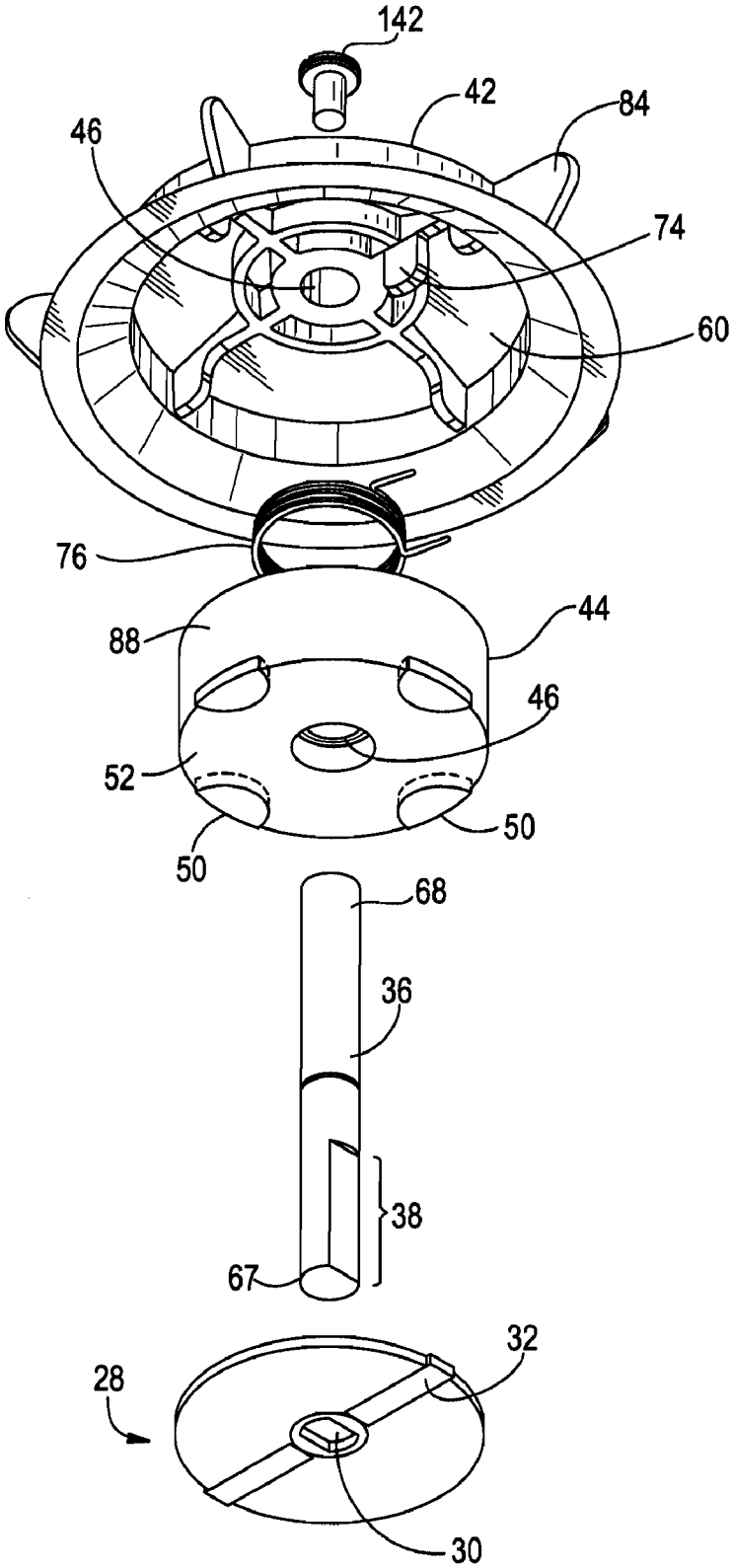
FIGS. 17 and 18 are exploded isometric views of a still further embodiment of a drive mechanism of a drive mechanism for a paintball loader according to the present invention.
Figure 18:
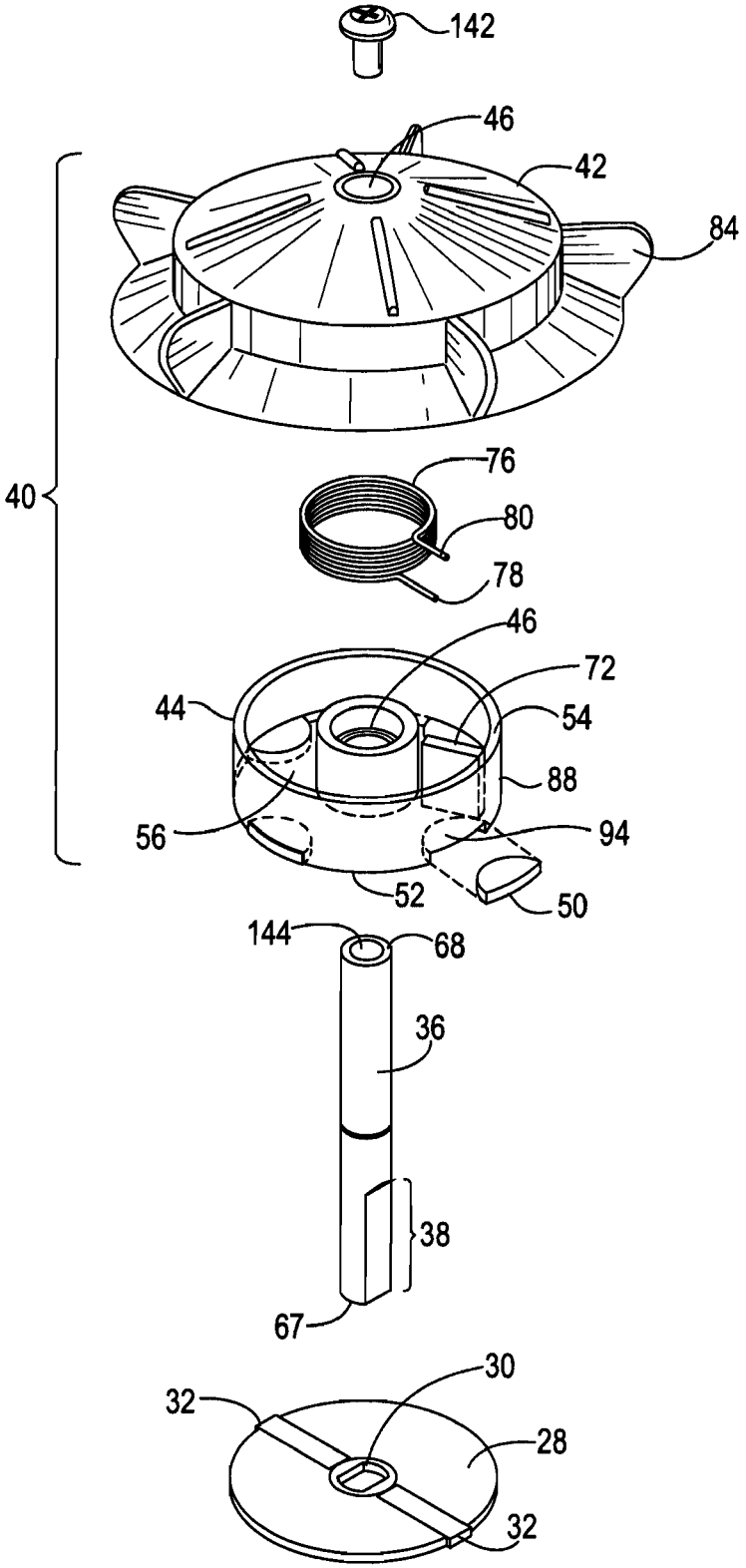
Figure 20:
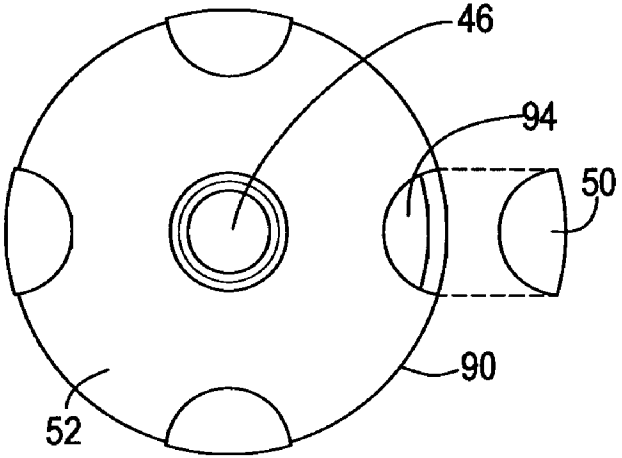
FIG. 20 is a bottom plan view of a base portion of the feed mechanism of the present invention.

FIGS. 17-18 show a paintball feed mechanism 40 according to one embodiment of the present invention. The feed mechanism 40 shown may be similar in design and operation to the active feed assemblies disclosed in U.S. Pat. Nos. 6,792,933 and 6,701,907, the entire contents of which are incorporated fully by reference herein, which are used in connection with the well known HALO B® or EMPIRE™ RELOADER™ B paintball loaders. It is noted that the present invention may be used with, in place of, or as an adjunct to any other feed mechanism, agitator, paddle or impeller of any kind.

Figure 29:
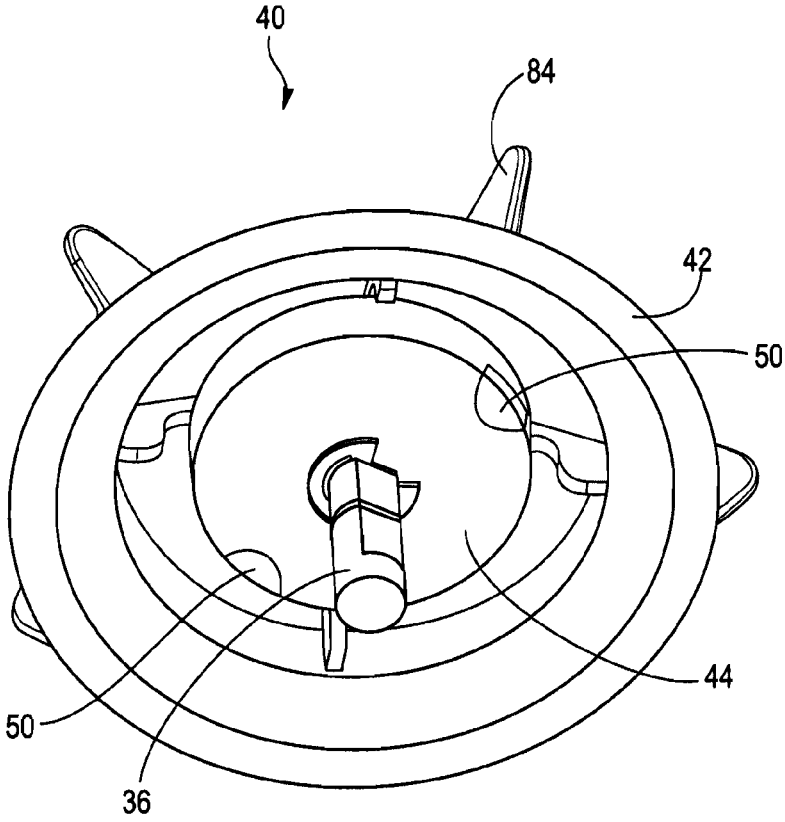
FIG. 29 is a bottom perspective view of an alternate feed mechanism.

According to this embodiment of the present invention, the feed mechanism 40 includes an impeller portion 42, and a base portion 44. The impeller portion has an opening 46 therethrough and the base portion 44 has an opening 48 therethrough. The openings 46, 48 are sized to accept a portion of the drive shaft 36, and to permit the feed mechanism 40 to freely rotate about the drive shaft 36. At least one binding element 50, preferably located on, formed in, inserted into, or affixed to the bottom surface 52 of the base portion 44. FIGS. 11, 17-20 show the base portion 44 substantially the same size and shape as the clutch plate 28. The feed mechanism 40 may be larger or smaller than the clutch plate 28 or of a different shape. It is appreciated that the feed mechanism 40 can be provided as a single unit, with at least one binding element 50 positioned at any position to be attracted magnetically to the binding element 32 of the clutch plate 28, such as on a lower wall 82 including one or a plurality of binding elements 50, as shown in FIG. 29.

In a preferred embodiment, the base portion 44 of the feed mechanism 40 may be formed as an open cylinder having an upstanding annular wall 54 and a floor 58, as shown in FIGS. 11, 17-19. The base portion 44 is positioned below the impeller portion 42. A gap or space 56 may be provided between the floor 58 of the base portion 44 and the lower face 60 of the impeller portion 42. In one embodiment of the present invention, the base portion 44 is formed as an open cylinder 88, having a base or floor 90 and an annular wall 92. The floor 90 may be provided with at least one or a plurality of cavities 94 sized and shaped to receive corresponding binding elements 50. The binding elements 50 can be sized and shaped to removably engaged the cavities 94 whereby the binding elements 50 will be sized to securely fit within the cavities 94 a shown in FIGS. 11, 19-20, so that they will not fall out of the cavities 94 during operation. By being able to interchange the binding elements 50, magnetic attractive forces between the at least one magnetic portion of the drive shaft and the at least one magnetic or magnetically attractable portion of the feed mechanism can be varied and regulated. In this way the magnetic force is less than a rupture force of a paintball adapted to be loaded by the feed mechanism.

In the embodiment of the drive mechanism 26 of the present invention, shown in FIGS. 17-19, 25-28, the feed mechanism has a spring-assist or spring-loaded component for feeding projectiles. A first spring contact wall 72 projects from the annular wall 54 of the base portion 44 into the gap 56. A second spring contact wall 74 projects from the lower face 60 of the impeller portion 42. A spring 76, preferably a torsion spring, is positioned within the gap 56, and has a first end 78 positioned adjacent the first spring contact wall 72, and a second end 80 positioned adjacent the second spring contact wall 74. It should be understood however, that any suitable biasing member can be used in lieu of the spring, e.g. an elastomer. When the base portion 44 turns for example in the counter-clockwise direction (looking at the base portion 44 from above the loader 10), and the impeller portion 42 is stationary (due to being blocked by, for example, stationary projectiles in a "paintball stack" (line of stationary projectiles) in the loader 10), or the impeller portion 42 is moved in the clockwise direction (looking at the impeller portion 44 from above the loader 10), the spring 76 will be compressed due to the relative movements of the first end 78 of the spring 76 against the first spring contact wall 72, and the second end 80 of the spring 76 against the second spring contact wall 74. The spring 76 compresses, storing potential energy for driving projectiles. This provides a "spring-loaded" drive mechanism, where spring tension is provided for force feeding projectiles during operation when the feed impeller portion 42 is free to move.

Figure 19:
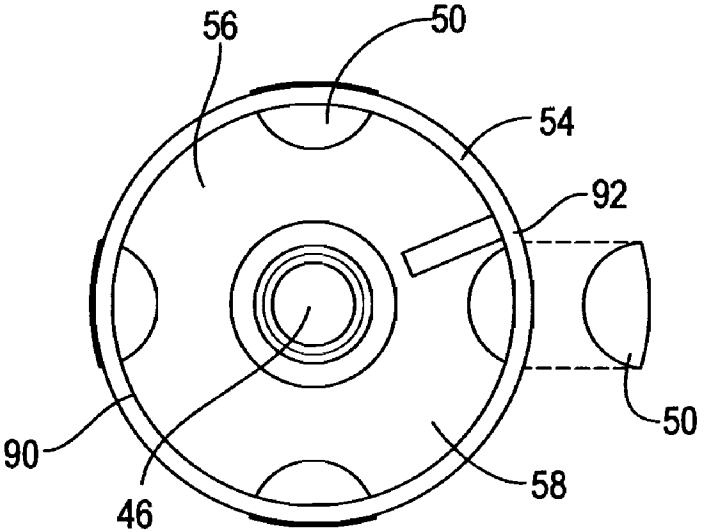
FIG. 19 is a top plan view of a base portion of the feed mechanism of the present invention.
Figure 21:
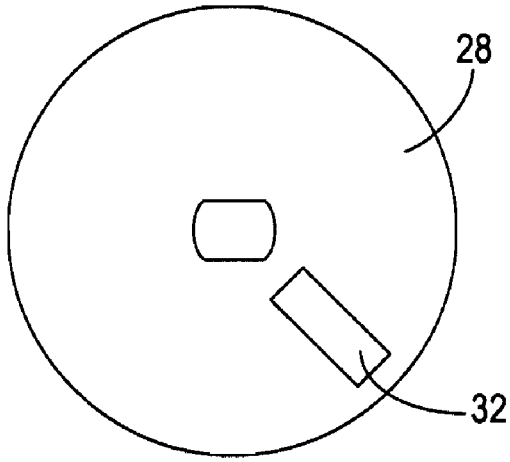
FIG. 21 is a bottom plan view of an alternate base portion of the feed mechanism of the present invention.
Figure 22:
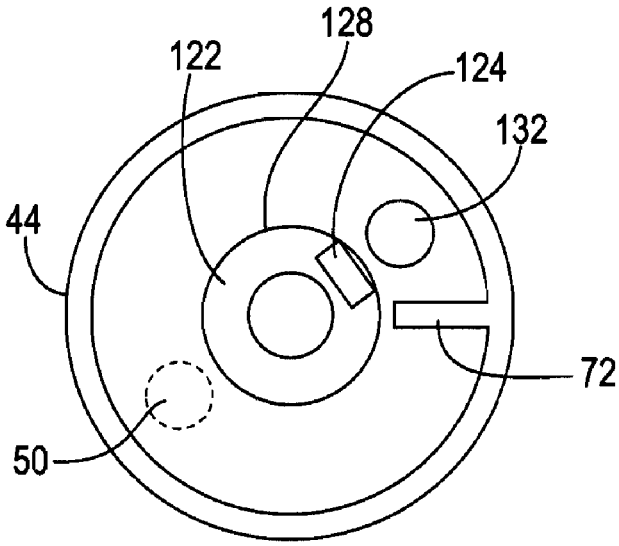
FIG. 22 is a top plan view of an alternate base portion of the feed mechanism of the present invention.

FIGS. 17-19 show an embodiment of the drive mechanism 26 of the present invention in an exploded view of the various components. The base portion 44 is positioned between the impeller portion 42 and the clutch plate 28. Where a spring is used, the spring 76 is positioned within the gap 56. The drive shaft 36 extends through the drive mechanism opening 30 and the respective openings 46, 48 of the base portion 44 and impeller portion 42. A screw 142 is threaded into the opening 144 of the drive shaft 36, and the screw 142 preferably has a head larger than the diameter of the opening 46, so that the feed mechanism 40 is held in place. The keyed portion 38 of the drive shaft 36 engages the keyed opening 30 of the clutch plate 28, such that rotation of the drive shaft 36 by the motor 66 produces rotation of the clutch plate 28. When the screw 142 is threadably engaged to the drive shaft 36, the screw 142 is effectively an extension of the drive shaft 36 running through the opening 46 in the feed mechanism 40. The feed mechanism 40 is free to rotate about the screw 142.

The binding element 32 of the clutch plate 28 is positioned to provide an attractive magnetic force when adjacent the binding element 50 of the base portion 44. It is appreciated that the binding element 32 and binding element 50 may be any combination of elements producing magnetic attraction between them, for example: binding element 32 is a magnet of a first polarity, and binding element 50 is a magnet of a second an opposite polarity; binding element 32 is a magnet, and binding element 50 is a magnetically attractable insert attractable to the magnet; and/or, binding element 32 is a magnetically attractable insert, and binding element 50 is a magnet.

The attractive magnetic force (also referred to herein as the "adhesion force") between the binding elements 32, 50 is preferably such that when the drive shaft 36 rotates and turns the clutch plate 28, the magnetic attraction between the binding element 32 and the binding element 50 correspondingly rotates the base portion 44 of the feed mechanism 40, which in turn rotates the impeller portion 42 of the feed mechanism 40. If a spring 76 is used, the rotation of the base portion 44 will be translated to the impeller portion 42 via movement of the first spring contact wall 72 against the end 78 of the spring 76, as described in greater detail above.

Figure 30:
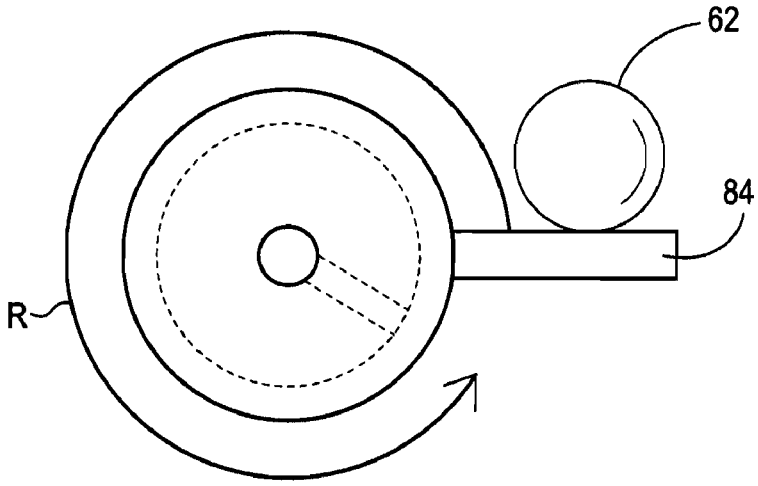
FIG. 30 is a top view of a feed mechanism of the present invention depicting rotation.

When the binding element 32 and the binding element 50 are aligned, the rotation of the clutch plate 28 drives the feed mechanism 40 by magnetic attraction between the binding elements 32, 50. During operation, the projection 84 of the impeller portion 42 may encounter a stationary or jammed projectile 62. In that situation, when the force of a stationary, jammed, or slow moving projectile 62 upon the feed mechanism 40 overcomes the magnetic force between the binding elements 32, 50, the motor 66 will continue to rotate the drive shaft 36, which will turn the clutch plate 28. The binding element 32 of the clutch plate 28 will "slip" or otherwise move past the binding element 50 on the base 44. The clutch plate 28 will continue to rotate independently of the feed mechanism 40. During each rotation of the clutch plate 28, the binding element 32 will be magnetically attracted to the binding element 50 of the base 44 when the binding elements 32, 50 are in proximity such that they are magnetically attracted. When the feed mechanism 40 is free to again rotate (such as when the paintball stack is moving, or a jammed projectile 62 is dislodged) the binding element 32 will again attract the binding element 50, and the feed mechanism 40 will rotate to propel or otherwise mix projectiles 62.

Where a spring 76 is used as discussed in detail above, the binding elements 32, 50 should be selected such that the magnetic force (adhesion force) between the binding elements 32, 50 is strong enough to overcome the biasing force of the spring 76 on the walls 72, 74, yet will "slip" when the spring 76 is compressed or otherwise wound to a certain selected degree or amount. A paintball stack may form, for example, when a paintball marker to which a paintball loader is attached has indexed projectiles 62 in the outfeed tube and feed neck 22, but the paintball marker 12 is not being fired. Projectiles 62 back up forming a stack. When the projection 84 contacts the stationary paintball stack, the base portion 44 will continue to turn, by way of example, counter-clockwise, if the feeding direction is counter-clockwise. This will compress and increase tension in the spring 76 as the base portion 44 rotates relative to the impeller portion 42. However, it may be desired that the drive mechanism will slip (the adhesion force between the binding elements 32, 50 is overcome) when the spring 76 is compressed to a certain degree or amount, which may be a user selected degree or amount. For example, the binding elements 32, 50 may be selected such that, when the base portion 44 rotates a certain angular distance relative to the point of contact between the projection 84 and the paintball stack, the binding elements 32, 50 slip. This is shown schematically in FIG. 30, which is a schematic bottom view of a projection 84 contacting a paintball stack. The angular distance can be selected by a user, and can be any angular distance, with a preferred distance being approximately about 340 to 360 degrees of rotation.

Released from the forces of the attraction between the binding elements 32, 50, the base portion 44 will unwind (in a clockwise direction in the example) as the spring 76 releases tension. A second binding element 32 may be positioned on the clutch plate 28, to "catch" or attract the base portion 44 as it unwinds, so that the spring 76 does not fully decompress. In this manner, tension is retained in the spring 76 for propelling projectiles 62 once the stack begins to move. In addition, the slipping action of the drive mechanism will not force, break or otherwise crush or rupture projectiles. A plurality of binding elements 32 maybe provided on a clutch plate 28. Each of the binding elements 32 will attract the binding element 50, as the clutch plate 28 rotates.

The operation of the novel drive mechanism of the prevent invention can be adjusted in several ways. For example, the force necessary to overcome the magnetic attraction between the binding elements 32 and 50 can be adjusted by utilizing magnets of varying magnetic strengths. The size of the magnets used for the binding elements 32, 50 can be varied. The distance between the clutch plate 28 and the bottom surface 52 of the feed mechanism 40 can also be varied, thus adjusting the interaction of the magnets and/or magnet and magnetically attractable inserts. A shim or other divider piece can be formed between the clutch plate 28 and the bottom surface 52 of the feed mechanism 40. In addition, the spring 76 can further be selected having a particular tension.

Figure 5:
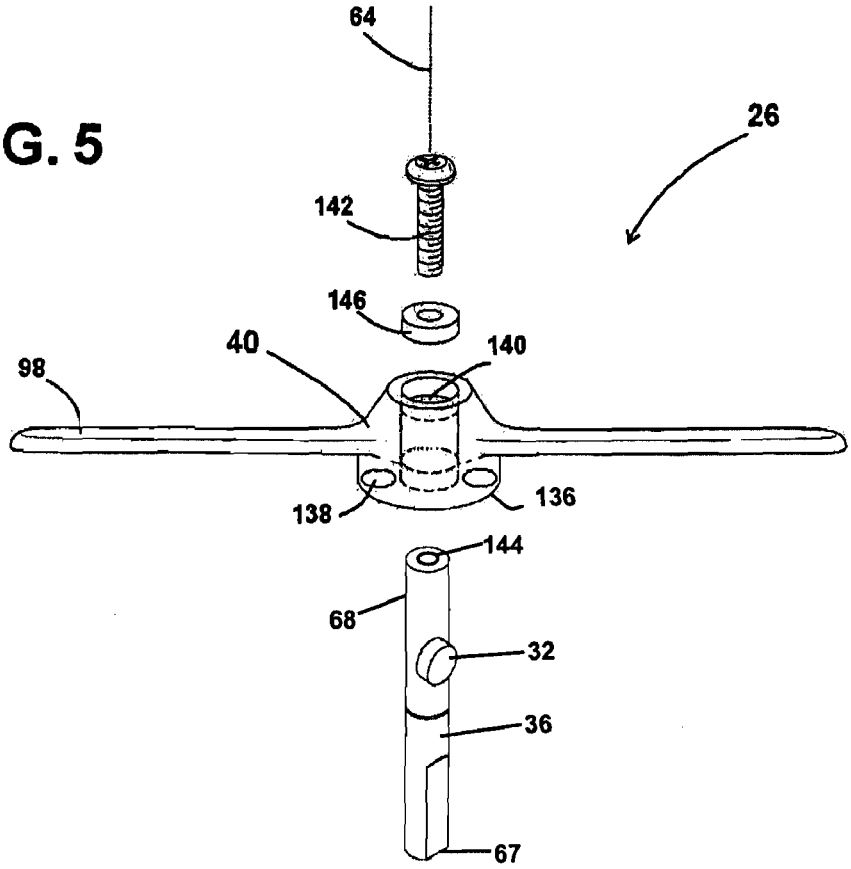
FIG. 5 is an exploded isometric view of a third embodiment of a drive mechanism for a paintball loader according to the present invention.

The number of binding elements 32, 50 can be varied, such as illustrated in FIGS. 14-15, 17-18. A user of a paintball loader according to the present invention can adjust the operation by selectively inserting and positioning binding elements 50 within the cavities 94. Alternately, a cylinder 88 can be provided with a preselected number of binding elements 50, attached or affixed to, formed in, or formed on the floor 90 of the cylinder 88. Several cylinders 88 may be included with a paintball loader kit, incorporating different numbers of binding elements 32 that may be user selected, based on operating conditions such as paintball shell brittleness. Similarly, as shown in FIGS. 5-7, the clutch plate 28 may be formed including at least one or a plurality of binding elements 32. The binding elements 32 can be preformed on or affixed to the clutch plate 28, or may be held within cavities formed in the clutch plate 28. Several drive mechanism bases 28 having different binding element 32 configurations may be provided in a kit with a paintball loader according to the present invention.

It should be appreciated that the drive system 34 operates as a clutch system to avoid or manage projectile jams, and to provide fine-tuning of paintball loader operation. If the feed mechanism 40 stops or slows its rotation relative to the rotation of the drive mechanism 26 and drive shaft 36 due to a jam, the system will not chop or otherwise break projectiles. Projectiles may back-up or otherwise block the outlet tube, and interfere with the rotation of the projections 84, which slows or stops the feeder 36. In the many loaders currently known in the art the feeder 36 continues to try to rotate with the force of the motor, and therefore, the projections 84 continue to try to impel projectiles through the loader. The continued impelling force from the feeder on the jammed projectiles can break the projectiles, the feeder 36, the impellers 39, and/or other parts of the loader.

In the present invention, when the feed mechanism 40 stops rotating, the force of the rotation of the drive shaft 36 on the clutch plate 28 overcomes the magnetic attraction between the binding elements 32, 50. This causes the feed mechanism 40 to move relative to, or slip past the base portion 44. The drive mechanism 26 no longer rotates the feed mechanism 40, which therefore, no longer rotates the feeder 36. Thus, the feeder impellers 39 stop moving against the stationary, jammed or blocked projectiles.

When the paintball jam is cleared (players often shake or jostle the hopper), and the feeder 36 and paintball feed mechanism 40 are free to once again rotate, the drive mechanism 26 binding element 32 will attract the paintball feed mechanism 40 binding element 50 and begin rotating the paintball feed mechanism 40 and the connected feeder 36 in conjunction therewith.

In another embodiment of the present invention, an entire surface of the clutch plate 28 may be formed as a binding element, such as a magnet or a magnetically attractable material. In addition, in another embodiment, an entire surface of the floor 58 of the base portion 44 may be formed as a binding element, such as a magnet or a magnetically attractable material.

Figure 23:
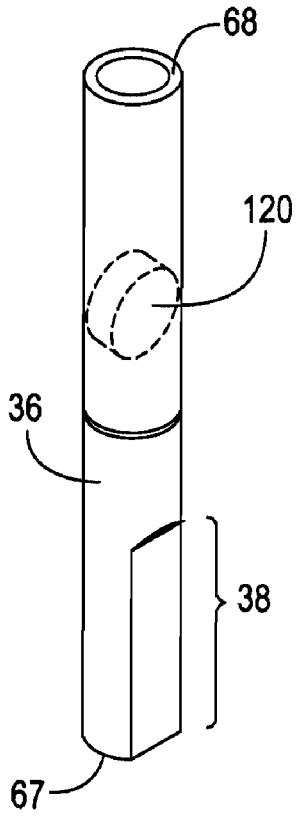
FIG. 23 is an isometric view of an alternative drive shaft of a drive mechanism for a paintball loader of the present invention.
Figure 24:
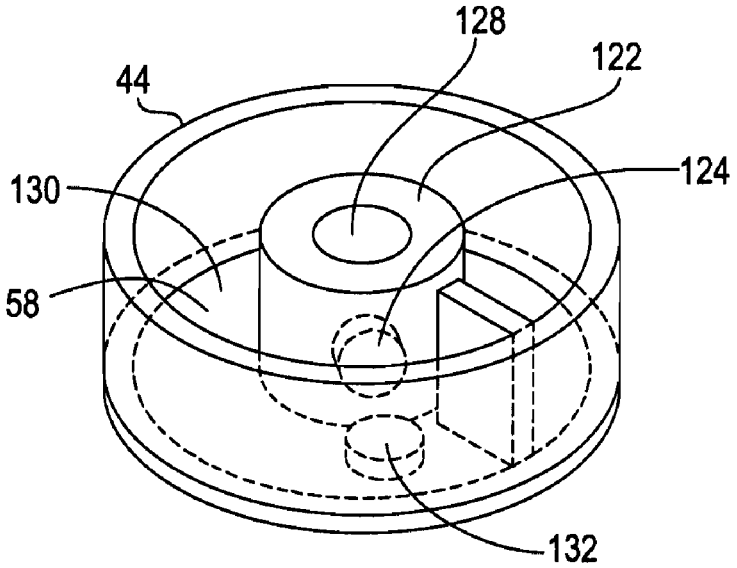
FIG. 24 is an isometric view of a base portion corresponding to the shaft of FIG. 23.
Figure 25:
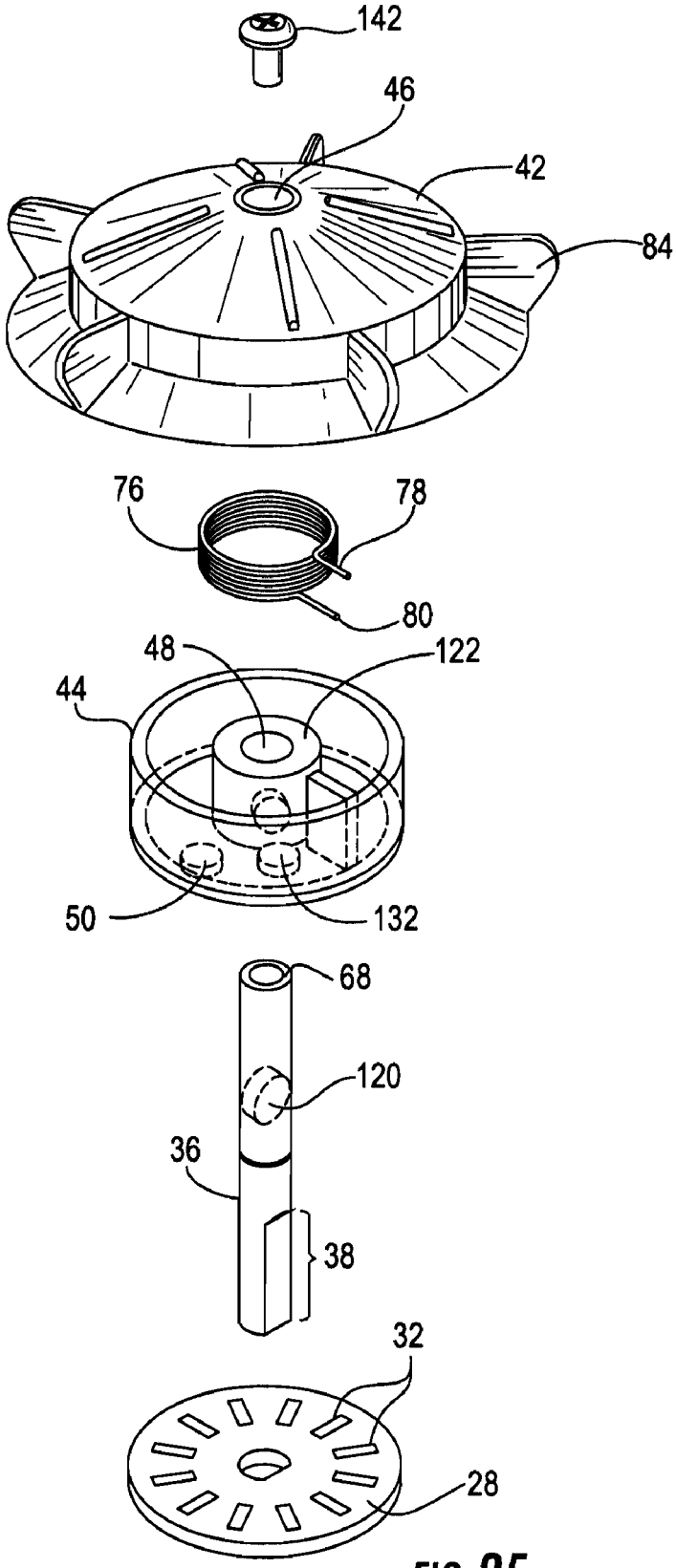
FIGS. 25 and 26 are exploded isometric views of a still further embodiment of a drive mechanism according to the present invention.
Figure 26:
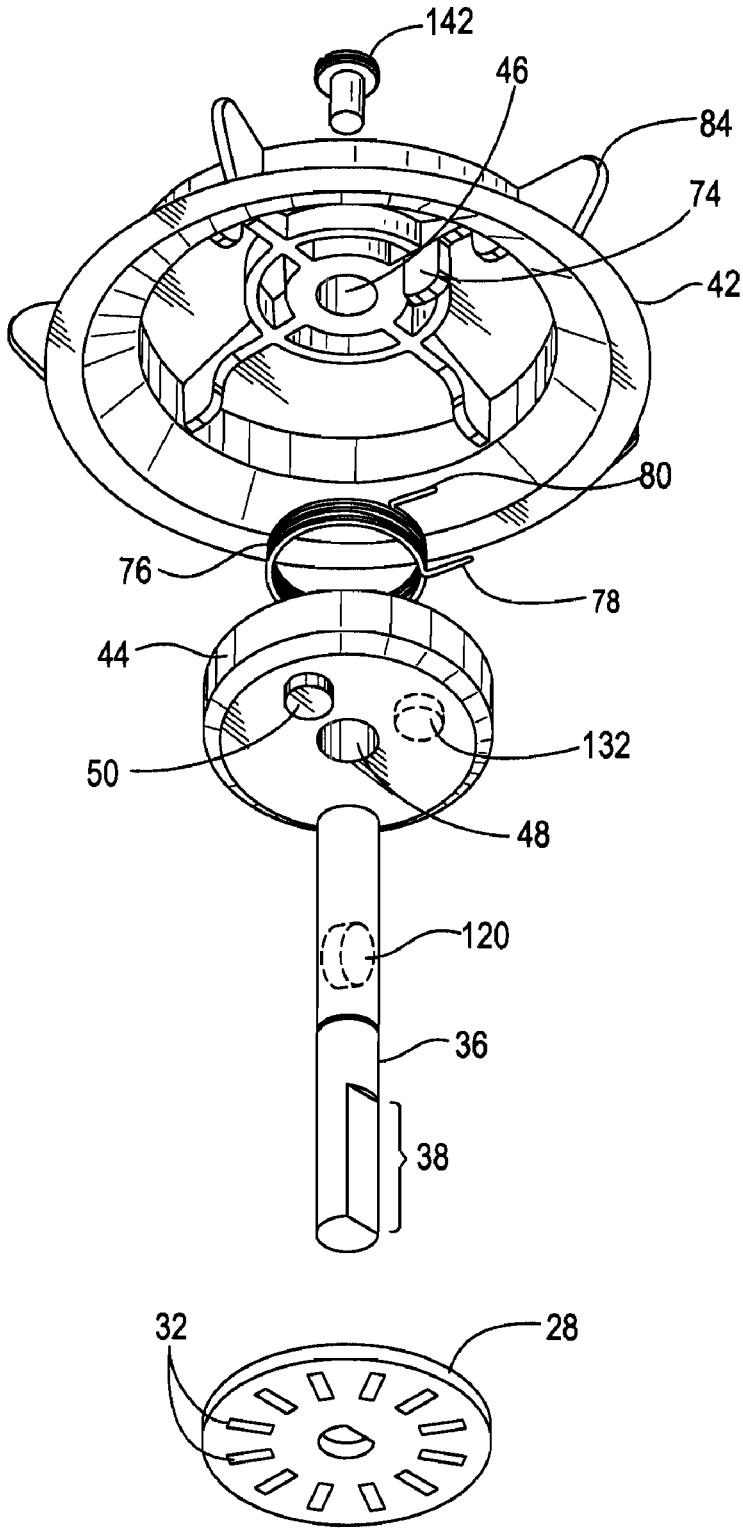

In another embodiment of the present invention, shown in FIGS. 21-26, the drive shaft 36 may be formed to act as an additional slip clutch mechanism. The embodiment shown in FIGS. 21-26 may be used in addition to the previously disclosed embodiments, or may replace the clutch plate 28 and base portion 44 as previously described. At least one binding element 120, which may be a magnet or magnetically attractable insert, is provided on or within the drive shaft 36, as shown in FIG. 23.

A central portion 122 of the base portion 44 is adapted to rotate independently from the other portions of the base portion 44. The central portion 122 includes at least one binding element 124, which may be a magnet or magnetically attractable insert, positioned adjacent an annular wall 128 of the central portion 122. Binding element 120 and binding element 124 are selected so that they are magnetically attracted to each other.

The upper surface 130 of the floor 58 of the base portion further includes at least one binding element 132, which may be a magnet or magnetically attractable insert. Binding element 132 is selected so that it is magnetically attracted to binding element 124.

In the embodiments shown in FIGS. 21-26, a second slip clutch mechanism is disclosed. The binding element 120 of the drive shaft 36 will rotate when the drive shaft 36 is rotated by the motor 66. Binding element 120 will magnetically attract binding element 124, thus rotating the central portion 122 through magnetic attraction. The binding element 124 will in turn attract binding element 132, thus turning, or assisting in turning, the balance of the base portion 44. These additional binding elements 120, 124, 132 can be use as adjuncts to the previously described binding elements 32, 50. Thus, binding element 32 will magnetically drive binding element 50, acting as a first magnetic slip clutch system, and binding element 120 will magnetically drive binding element 124, which in turn will magnetically drive binding element 132, acting as a second magnetic slip clutch system. Any combination and positioning of the various binding elements may be used to achieve desired operation of the drive mechanism 26 of the present invention.

Figure 27:
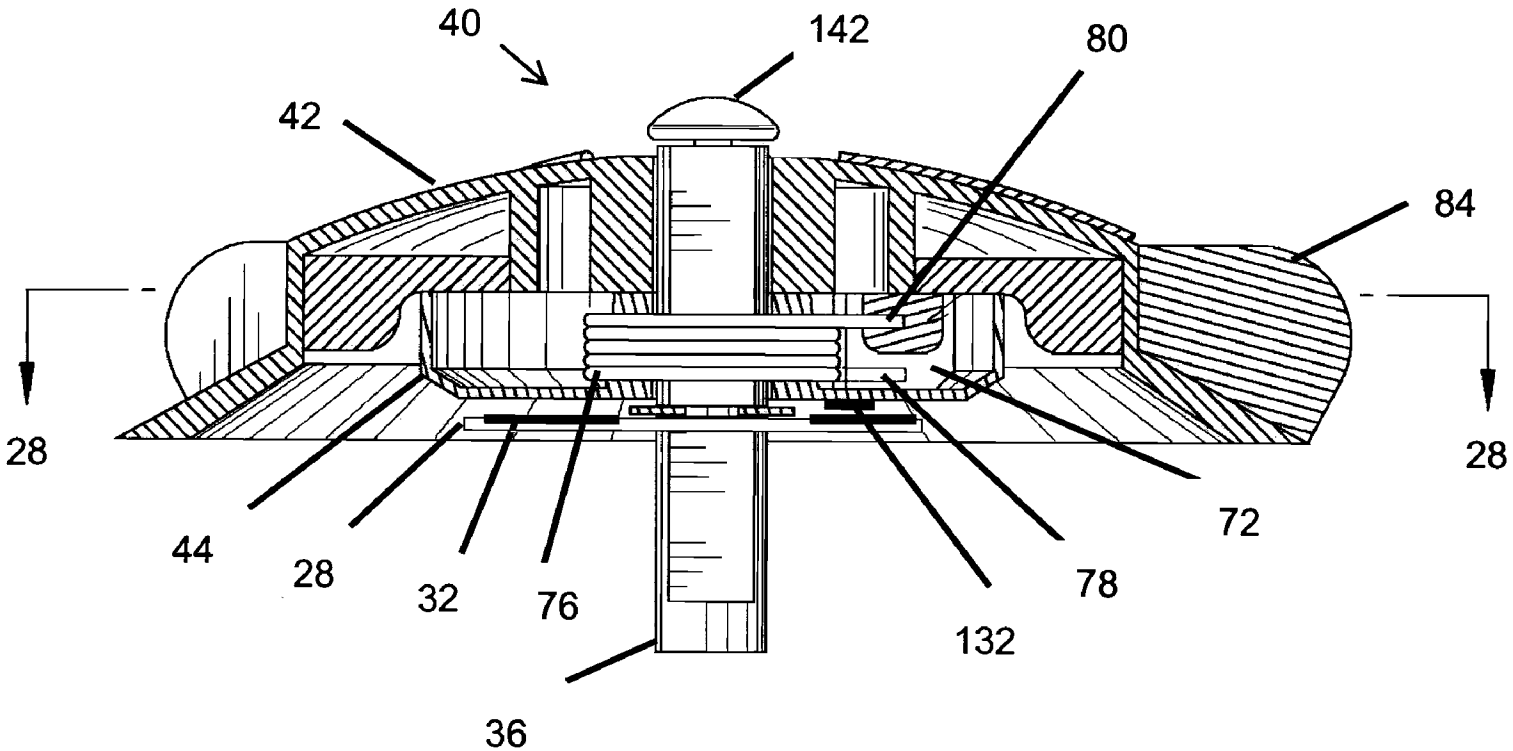
FIG. 27 is a side sectional view of the feed mechanism shown in FIGS. 25 and 26.
Figure 28:
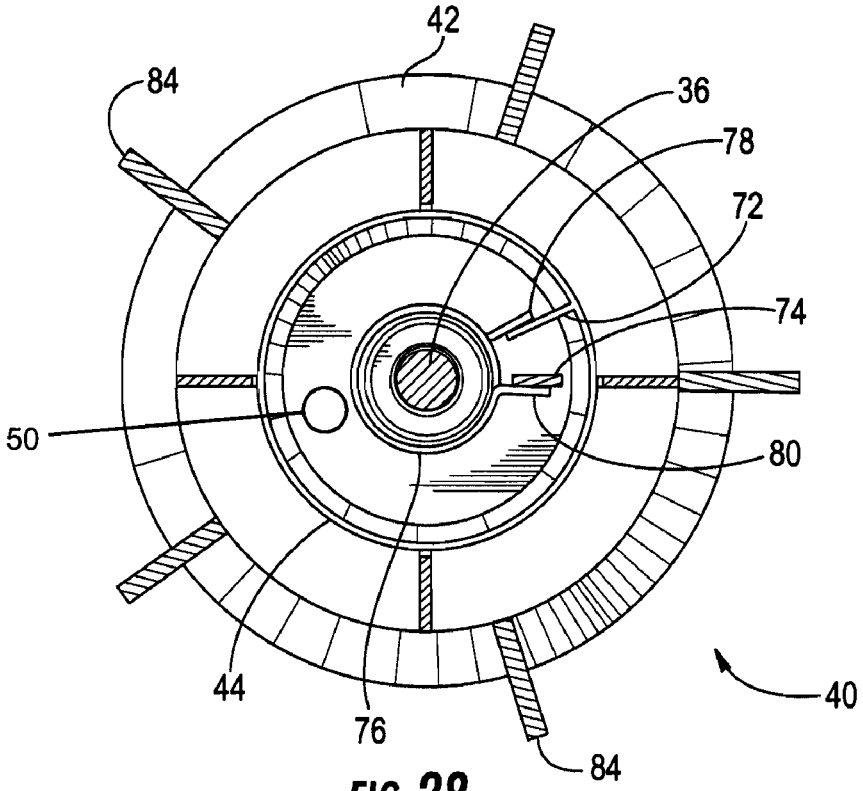
FIG. 28 is a sectional view taken along line 28-28 in FIG. 27.

A cross section of the feed portion 40 of the feed device 26 is shown in FIGS. 27 and 28. The base portion 44 houses the spring 76 having first and second ends 78, 80 that are biased against a first contact wall 72 of the base portion and a second contact wall 74 of the impeller portion 42, respectively. It should be understood that other biasing members can also be used, e.g. an elastomer. When sufficient tension is present in spring 76, the impeller portion 42 is rotated such that impeller projections 84 contact a projectile 62 to urge it into a feed tube 112 of a loader 10 and into a breech of a gun 12.

In addition, in an alternate embodiment, the clutch plate 28 can be eliminated, and the drive shaft 36 will act as the clutch system for the drive mechanism 26. Further, the central portion 122 can be eliminated, and the binding element 120 of the drive shaft 36 can be selected to directly magnetically attract the binding element 132 of the upper surface of the floor 130.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all other embodiments and changes to these embodiments which come within the meaning and range of equivalency of said claims are therefore to be embraced therein.

What is claimed is:

1. A paintball loader comprising:

a loader body having an interior area for receiving a plurality of paintballs, an exit opening, and an outfeed tube in communication with the exit opening and configured to communicate with the infeed portion of a paintball gun;

a drive shaft, rotatable about a central axis, having first and second ends and having at least one magnetic portion adjacent the second end; and, a paintball feed mechanism that moves paintball toward the exit opening, rotatable about the central axis and including at least one magnetic or magnetically attractable portion positioned to come into proximity with the at least one magnetic portion so that the paintball feed mechanism is releasably magnetically coupled for movement with the drive shaft.

2. The paintball loader of claim 1, further comprising a motor coupled to the first end of the drive shaft.

3. The paintball loader of claim 2, further comprising a controller in operative communication with the motor.

4. The paintball loader of claim 3, further comprising a sensor in operative communication with the controller.

5. The paintball loader of claim 3, wherein the rotation of the drive shaft is reversible.

6. The paintball loader of claim 1, wherein the drive shaft remains rotatable if the paintball feed mechanism is prevented from rotating.

7. The paintball loader of claim 1, wherein the paintball feed mechanism comprises a base portion which includes the at least one magnetic or magnetically attractable portion.

8. The paintball loader of claim 1, wherein the paintball feed mechanism further comprises: an impeller portion and a drive spring having a first end and a second end, the first end of the drive spring coupled to the impeller portion; and a base portion having a magnetic or magnetically attractable portion and is coupled to the second end of the drive spring, the base portion being operable to wind the drive spring.

9. The paintball loader of claim 1, wherein magnetic attractive forces between the at least one magnetic portion of the drive shaft and the at least one magnetic or magnetically attractable portion of the paintball feed mechanism is less than a rupture force of a paintball adapted to be loaded by the paintball feed mechanism.

10. A paintball loader comprising:

a paintball loader body for housing a plurality of paintballs;

a drive shaft within the loader body rotatable about a central axis having a keyed portion;

a clutch plate, having a mating keyed opening mounted on the drive shaft, the clutch plate including at least one first magnetic element, the keyed opening matingly engaged with the keyed portion of the drive shaft; and a paintball feed mechanism rotatable about the central axis adjacent to the clutch plate, the paintball feed mechanism including at least one of a second magnetic element or magnetically attractable element attractable to the first magnetic element.

11. The paintball loader of claim 10, further comprising a motor coupled to the drive shaft.

12. The paintball loader of claim 11, further comprising a controller in operative communication with the motor.

13. The paintball loader of claim 12, further comprising a sensor in operative communication with the controller.

14. The paintball loader of claim 13, wherein the rotation of the drive shaft is reversible.

15. The paintball loader of claim 10, wherein the drive shaft remains rotatable if the paintball feed mechanism is prevented from rotating.

16. The mechanism paintball loader of claim 10, wherein the paintball feed mechanism comprises a base portion which includes the at least one of a second magnetic element or magnetically attractable element.

17. The paintball loader of claim 10, wherein the paintball feed mechanism further comprises: an impeller portion and a drive spring having a first end and a second end, the first end of the drive spring coupled to the impeller portion; and a base portion which includes the at least one of a second magnetic element or magnetically attractable element and is coupled to the second end of the drive spring, the base portion being operable to wind the drive spring.

18. A method for driving paintballs in a paintball loader comprising the steps of a) providing the paintball loader, comprising a loader body incorporating a including: i) a drive shaft rotatable about a central axis having at least one first magnetic element; ii) a paintball feed mechanism mounted for rotation about central axis and having at least one second magnetic element magnetically attractable to the first magnetic element; and b) rotating the drive shaft; c) rotating the paintball feed mechanism via magnetic force between the at least one first magnetic element and at least one second magnetic element.

19. The method of claim 18, wherein, the at least one first magnetic element and the at least one second magnetic element form a magnetic coupling between the drive shaft and the paintball feed mechanism.

20. The method of claim 18, wherein the magnetic coupling causes the paintball feed mechanism to rotate in unison with the drive shaft.

21. The method of claim 18, wherein the magnetic coupling disengages if the paintball feed mechanism is unable to rotate.

* * * * *